United States Patent [19]

Baon

[11] 4,435,701

[45] Mar. 6, 1984

[54] PORTABLE INTRUSION ALARM

[76] Inventor: Carlos P. Baon, 1763 Geneva Ave., San Francisco, Calif. 94134

[21] Appl. No.: 435,421

[22] Filed: Oct. 20, 1982

Related U.S. Application Data

[63] Continuation-in-part of Ser. No. 288,606, Jul. 30, 1981, abandoned.

[51] Int. Cl.[3] ..... G08B 13/14

[52] U.S. Cl. ..... 340/546; 340/689

[58] Field of Search ..... 340/546, 689

[56] References Cited

U.S. PATENT DOCUMENTS

| | | | |
|---|---|---|---|
| 3,345,627 | 10/1967 | Herst et al. | 340/283 |
| 3,614,763 | 10/1971 | Yannuzzi | 340/279 |
| 3,710,371 | 1/1973 | Whalen et al. | 340/283 |
| 4,264,899 | 4/1981 | Menzies et al. | 340/546 |

FOREIGN PATENT DOCUMENTS 2000347 4/1979 United Kingdom .

*Primary Examiner*—Glen R. Swann, III

*Attorney, Agent, or Firm*—Townsend and Townsend

[57] ABSTRACT

A portable alarm includes a battery, a horn connected across the terminals of the battery, a position sensitive switch and a double pole, double throw magnetic latching relay, all mounted within a housing having an unstable base. The first coil, first relay switch and the position sensitive switch are connected in series with one another and in parallel with the battery. The second coil, second relay switch and silencing switch are connected in series with one another and in parallel with the battery. The horn and third relay switch are connected in series with one another and in parallel with the battery. Tipping the housing closes the position sensitive switch which energizes the first coil to open the first relay switch and close the second and third relay switches. Opening the first relay switch immediately de-energizes the first coil. However closing the third relay switch completes the circuit between the battery and the horn to sound the alarm. To silence the alarm the user must upright the alarm to open the position sensitive switch and actuate the silencing switch. This energizes the second coil to open the second and third switches to both shut off the horn and de-energize the second coil.

9 Claims, 3 Drawing Figures

PORTABLE INTRUSION ALARM

CROSS-REFERENCE TO A RELATED APPLICATION

This is a continuation-in-part of U.S. patent application Ser. No. 288,606, filed July 30, 1981 now abandoned.

BACKGROUND OF THE INVENTION

1. Field of the Invention

This invention relates to alarms, particularly portable, position sensitive alarms used to warn of an intruder.

2. Description of the Prior Art

Many people find that they are not as secure when staying in a hotel or motel room as they would like to be. Although valuables usually can be removed from the room when one is not occupying it, that degree of safety is absent when one is asleep in the room at night. A real or perceived danger when staying in an unfamiliar room can cause anxiety and lessen the quality of a night's sleep and the pleasure of the stay.

One way to help protect travelers is with a portable alarm which can be actuated when someone opens a door and enters the room. Portable alarms using position sensitive switches, such as mercury switches, are well known. U.S. Pat. No. 3,710,371 to Whalen et al. discloses a portable alarm which can be activated by moving or tipping the container. The Whalen patent discloses an alarm using a battery, a mercury switch, a master arming switch, and an SCR in series with a horn mounted in a cylindrical case. The gate of the SCR is connected to a feedback loop coupled to the mercury switch. Because the SCR and horn are in series, if the SCR fails and becomes an open circuit the horn will not sound regardless of the position of the alarm.

Another shortcoming of prior art portable alarms is that their circuits often require a substantial amount of energy for powering circuit components other than the warning device, typically a buzzer or horn. For example, certain circuits may drain the battery while the alarm is armed even though the mercury switch is open. Other circuits may require electrical energy to be used for powering circuit components, other than the warning device, while the warning device is sounding its alarm. With such circuits a maximal amount of energy is not available from the battery for actuating the horn or other warning device which can lessen the effectiveness of the alarm.

SUMMARY OF THE INVENTION

A portable alarm includes a battery, a horn connected across the terminals of the battery, a position sensitive switch and a double pole, double throw magnetic latching relay. The relay includes first and second coils surrounding permanent magnet cores. Energizing the first coil closes two relay switches and opens two others. Actuating the second coil opens the formerly closed relay switches and the closes the formerly open relay switches. The permanent magnet cores keep the relay switches open or closed according to which coil was last energized.

The first coil, a first relay switch and the position sensitive switch are connected in series with one another and in parallel with the battery. The second coil, a second relay switch and a silencing switch are connected in series with one another and in parallel with the battery. The horn and a third relay switch are connected in series with one another and in parallel with the battery. The fourth relay switch is not used. An arming switch is used to complete the current path to the first coil, position sensitive switch and first relay switch. The relay switches are arranged so that when the first relay switch is closed, which occurs by energizing the first coil, the second and third relay switches are open. Energizing the second coil opens the first switch and closes the second and third switches.

The components are mounted in a housing which has a base which tapers inwardly. The bottom of the base has a nonskid surface along its lower rounded edge.

After the alarm is armed by closing the arming switch, tipping the housing closes the position sensitive switch. Assuming the first relay switch was closed, the first coil is energized opening the first relay switch and closing the second and third relay switches. Opening the first relay switch immediately de-energizes the first coil. The positions of the relay switches are maintained by the permanent magnet in the first coil. Closing the third relay switch completes the circuit between the battery and the horn to sound the alarm.

To silence the alarm the user must upright the alarm to open the position sensitive switch and insert a coin into the silencing slot to energize the second coil. Energizing the second coil opens the second and third switches to both shut off the horn and de-energize the second coil. The first relay switch is again closed to await tipping of the alarm.

The alarm is particularly suited for use by travelers who wish to be protected while they are in their hotel or motel rooms. To arm the alarm the user closes the arming switch. The alarm is then placed on the floor so that it leans against an entry door. The tapered base of the housing has a nonskid surface along its lower, rounded edge to keep it from inadvertently tipping over.

If the door is opened the alarm tumbles over to activate the position sensitive switch. Once this occurs the horn is provided with electricity from the battery causing the horn to sound. The horn continues to sound regardless of the subsequent positioning of the housing, and thus whether or not the position sensitive switch is open or closed, because the third relay switch provides the horn with an electrical path to the battery. Opening the arming switch will not shut off the horn.

A primary feature of the present invention derives from the use of the magnetic latching relay and the placement of the three operational switches, one in series with the horn and the other two in series with the two coils. This configuration insures that very little energy is used by the control circuit components. That is, it only takes a matter of a millisecond or so to energize either of the coils causing the relay contacts to open or close resulting in the almost instantaneous cutoff of energy to the coil. Thus virtually all of the energy in the battery is used to sound the horn, rather than operate any of the other circuit components, to increase the useful life of the device.

Another feature of the invention is the use of a coin to silence the alarm. This has several advantages. If the alarm is inadvertently actuated, the user can silence the alarm by righting it and inserting a readily available coin into the silencing slot. Although the silencing switch could be made to be actuated by a key, embarrassment may result from the user's inability to locate the silencing key and thus may make such a feature somewhat undesirable. However an intruder suddenly confronted with a blaring horn would likely have a difficult time silencing the alarm. To silence it the intruder would have to determine what must be done, find a suitable coin and then insert the coin into the silencing slot. The intruder would no doubt have a more difficult time in silencing the alarm than if a conventional on-off switch were used.

The housing of the alarm preferably has a narrowed lower portion providing it with an unstable base on which to rest. A nonskid surface on the rounded base serves to keep the alarm from slipping along the floor. This ensures that the alarm does not tip over accidently as a result of the normal vibrations in the building. When the alarm is placed on the floor resting against the door, the nonskid surface also ensures that if the door opens against the alarm, the alarm does not merely slide across the floor but is pushed over as intended.

The alarm of the present invention can also be used by persons as a personal security device. When so used the user first arms the alarm using the arming switch and typically places it upright in a satchel or purse. If the user has their purse or satchel snatched, unless the thief keeps it substantially upright, an unlikely occurrence, the alarm will sound as soon as the position sensitive switch in the alarm has been tilted sufficiently to close it. Further, if the user is attacked, merely tipping the alarm to one side, as would occur when the user drops the purse or satchel on the ground, or tipping it over while seated in a car, will cause the alarm to sound to scare away the attacker.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 2:
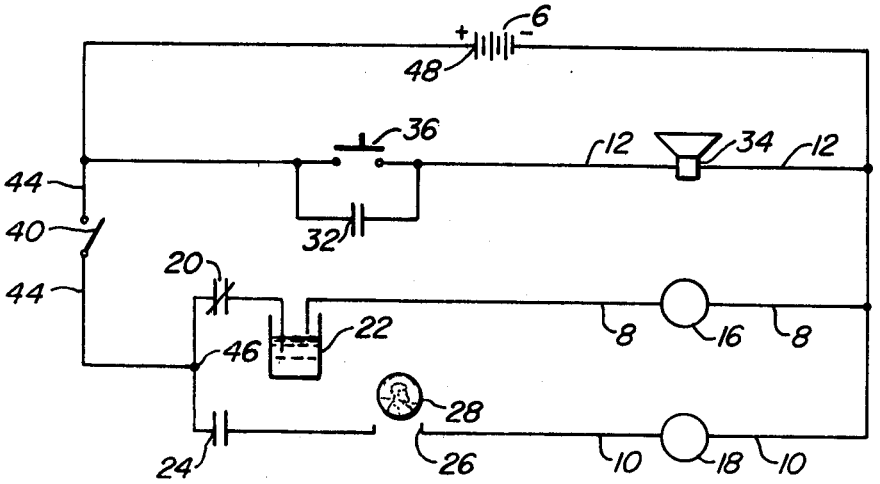
FIG. 2 is a schematic diagram of the circuit components of the alarm of the present invention.

Turning now to the figures, the alarm 2 of the invention includes generally a housing 4 within which the circuit components shown in FIG. 2 are mounted in conventional fashion. The housing is preferably made of a tough material to withstand physical assaults such as being thrown against a wall.

A battery 6 is used to power the various circuit components. Battery 6 is mounted in parallel with a first conductor 8, a second conductor 10 and a third conductor 12.

A double pole, double throw magnetic latching relay 14, such as that sold by Rundel IDEC of Redwood City, Calif., as part number RR2KT, includes a first coil actuator 16 connected in series along first conductor 8, a second coil actuator 18 connected in series along second conductor 10 and four relay controlled switches. With the present invention only three of the relay switches are used. A first relay controlled switch 20 is connected along first conductor 8 in series with coil actuator 16 and a position sensitive mercury switch 22. A second relay controlled switch 24 is connected along second conductor 10 in series with second coil actuator 18 and a silencing switch 26. Silencing switch 26 is actuated (closed) by inserting a coil 28 into a slot 30 formed in housing 4. A third relay controlled switch 32 is connected along third conductor 12 in series with a horn 34.

Two other user actuated switches are also used with the preferred embodiment. A normally open test switch 36 is connected in parallel with third switch 32. Switch 36 is mounted to extend through an aperture 38 in housing 4. Actuating switch 36 completes the circuit between battery 6 and horn 34 to test if the horn and battery are operational. An arming switch 40 is also used with the preferred embodiment. Switch 40 extends through a slot 42 formed in housing 4 to allow the user to arm or disarm alarm 2. Switch 40 is connected in series along a fourth conductor 44 which connects a common junction 46 of the first and second conductors with the positive terminal 48 of battery 6.

Figure 3:
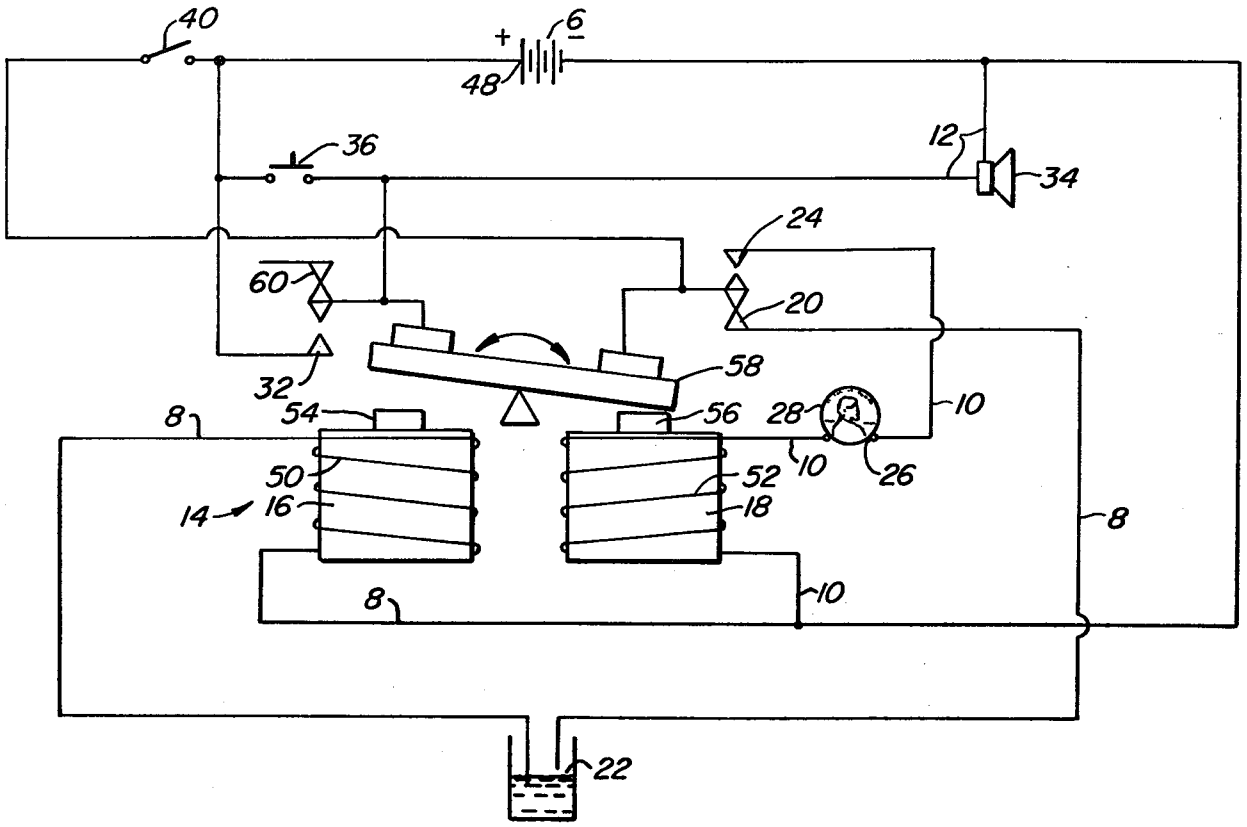
FIG. 3 illustrates the circuit of FIG. 2 illustrating the magnetic latching relay.

FIG. 3 is a somewhat more graphic representation of the circuit components of FIG. 2. Coil actuators 16, 18 include windings 50, 52 electrically connected along conductors 8, 10 and wound about permanent magnet cores 54, 56. A pivotally mounted ferromagnetic armature 58 is positioned above cores 54, 56 and is attracted to them. Assuming that armature 58 is in the position shown, that is with one end touching core 56, first switch 20 is closed while second and third switches 24, 32 are open. A fourth relay controlled switch 60 is not used in this embodiment. Assuming arming switch 40 is closed and silencing switch 26 is open, tilting alarm 2, closing mercury switch 22, allows current to flow from battery 6 through windings 50 of first coil actuator 16. This creates a stronger magnetic field along core 54 thus pivoting armature 58 toward core 54 to open first switch 20 and close second and third switches 24, 32. Opening switch 20 however stops the current flow through first conductor 8 but allows current to flow through third conductor 12 and thus sound horn 34. In this configuration no current flows through either first or second coil actuator 16, 18 to reduce the drain on the battery.

To silence horn 34 alarm 2 is placed upright so that mercury switch 22 is open. A coin 28 is then inserted through slot 30 to close silencing switch 26. This allows current to flow through windings 52 of second coil actuator 18 thus causing armature 58 to pivot back towards permanent magnet core 56. This opens switches 24, 32 and closes switch 20. Current once again stops flowing through either first or second coil actuators 16, 18.

Positioning arming switch 40 to control flow of current to both first and second coil actuators 16, 18 creates a somewhat unusual result. If, after second and third switches 24, 32 are closed to actuate horn 34, arming switch 40 is opened, nothing the user may do will silence the horn. This is because even if silencing switch 26 is closed, no current will flow past arming switch 40 so that the relay controlled switches will remain as they were. This can be an advantage. If an intruder tips over the alarm and discovers the arming switch, the intruder may turn it off in an attempt to silence the alarm. After that does not work, if the arming switch is not closed, even if a coin is placed within slot 30, such efforts will be futile. If desired arming switch 40 may be placed along first conductor 8. This would eliminate the above-described aspect if the user wishes to do so.

Figure 1:
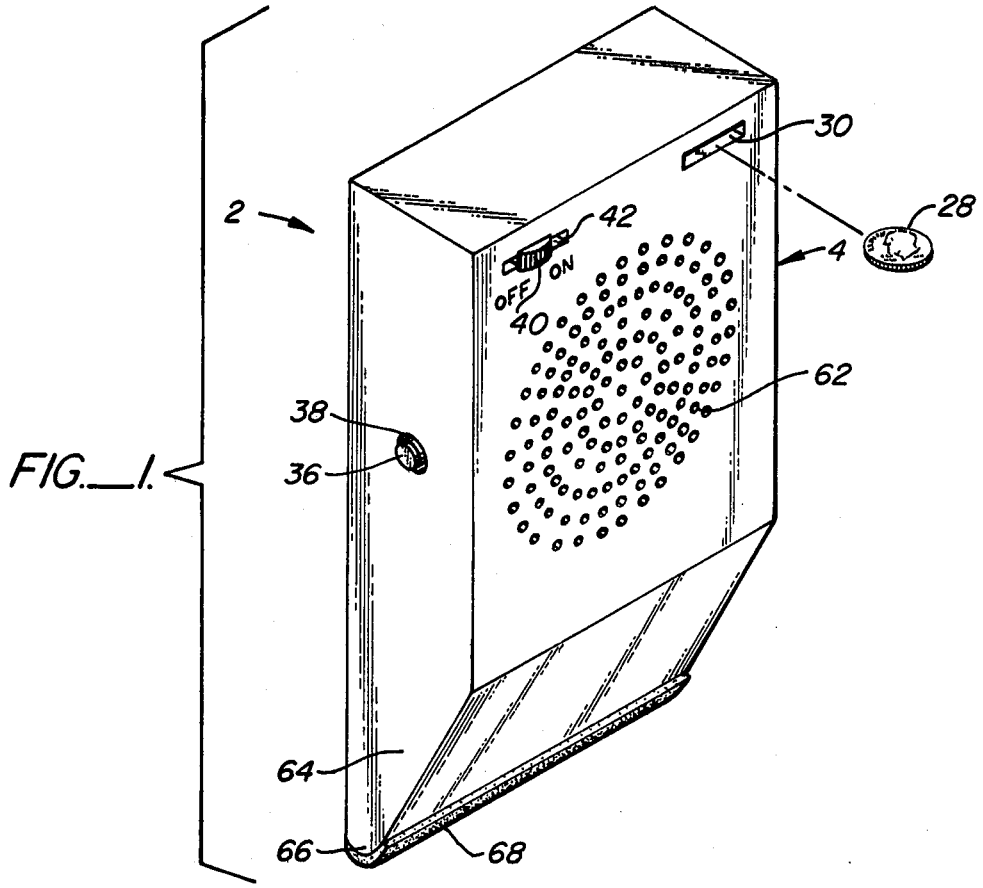
FIG. 1 is an isometric view of an alarm made according to the present invention.

Referring again to FIG. 1, housing 4 is generally rectangular and has a perforated portion 62 against which horn 34 is mounted. The lower portion 64 of housing 4 is tapered and has a rounded, offset lower edge 66, and a nonskid surface 68 is applied to lower edge 66. Nonskid surface 68 has a roughened surface texture so that when housing 4 is placed on the floor to lean against a door, sufficient friction exists between surface 68 and the floor to keep alarm 2 from inadvertently falling over. If desired, nonskid surface 68 could have a tacky or sticky surface as well.

In use as an entry or intrusion alarm, the user, holding the unit upright, arms the alarm by closing arming switch 40. In the preferred embodiment mercury switch 22 is configured so that slight tilting will not cause the mercury switch to close. Rather, it is preferred switch 22 is configured so that housing 4 must be more than about 45° from the vertical to cause switch 22 to close. This allows the alarm to be leaned against a door without actuation of the alarm.

After arming, the user places the alarm next to a door with nonskid surface 68 resting on the floor. The alarm is typically placed to lean against the door so that if the door opens outwardly away from the alarm the alarm will tumble over causing mercury switch 22 to close. If the door is of the type which opens inwardly against the alarm, the alarm will also be upset. The narrowed lower portion 64 provides alarm 2 with an unstable base to ensure that the alarm will not remain upright unless leaning against something. Providing rounded lower edge 66 further ensures the instability of the alarm. Nonskid surface 68 keeps the alarm from merely being pushed along the floor when the door is opened against the alarm as could occur if the lower surface were smooth. It also ensures that the lower edge does not inadvertently slip along the floor, such as may be caused by natural building vibrations, which could result in a false alarm.

In use as a personal alarm, the user arms alarm 2 using switch 40 while keeping the alarm generally upright. The alarm is placed upright in the user's purse or satchel. Mercury switch 22 is preferably configured so that the moderate swinging movements of the user's purse does not actuate the alarm. If the user is to operate an automobile, the purse or satchel can be placed upright on the floor or seat but close enough so that if the need arises it can be turned over to activate the alarm. Alarm 2 is disarmed by opening arming switch 40.

Modification and variation can be made to the disclosed embodiment without departing from the subject of the invention as defined in the following claims. For example the housing could include a ring so that a string, attached to a window or door, could be tied to the alarm to cause the alarm to tumble over when the string is pulled. Also, instead of horn 34 a radio transmitter could be used to signal a central location of an intrusion. In addition, slot 30 may be camouflaged or partially hidden to help thwart an intruder's attempts to silence the alarm.

I claim:

1. A portable, tippable alarm comprising:

an electrical source having first and second terminals;

an electric warning device;

a latch relay comprising:

first and second latching actuators;

first, second and third switches; and operating means, operably coupled to said actuators, for closing said second and third switches and opening said first switch when in a first position and for opening said second and third switches and closing said first switch when in a second position;

a position sensitive switch;

first conductor means for electrically connecting said first switch, said position sensitive switch and said first actuator in series with one another and in parallel with said electrical source;

second conductor means for electrically connecting said second switch and said second actuator in series with one another and in parallel with said electrical source;

a normally open silencing switch connected in series along said second conductor means;

third conductor means for electrically connecting said third switch and said warning device in series with each other and in parallel with said electrical source; and housing means for housing said warning device, said latch relay, said first, second and third conductor means and said position sensitive switch, said position sensitive switch being mounted in said housing means so when said housing means is upright said position sensitive switch is open and when said housing means is displaced substantially from being upright said position sensitive switch is closed.

2. The alarm of claim 1 further comprising a test switch mounted across the terminals of said third switch.

3. The alarm of claim 1 further comprising an on-off switch means for selectively electrically isolating said first actuator from said electrical source.

4. The alarm of claim 3 wherein said on-off switch means includes an on-off switch mounted in series along a fourth conductor means for electrically connecting said first and second actuators to a terminal of said electrical source.

5. The alarm of claim 1 wherein said silencing switch includes a pair of spaced apart contacts positioned adjacent an opening in said housing means, said opening sized and positioned to allow a coin to be inserted at least partially into said housing means through said opening to allow said coin to touch said contacts thereby creating an electrically conductive path between said contacts, whereby when said second and third switches are closed inserting the coin energizes said second actuator to actuate said operating means thereby opening said second and third switches to silence said warning device.

6. The alarm of claim 1 wherein said actuators each include a permanent magnet core and a coil wound about the core.

7. The alarm of claim 1 wherein said housing means includes a narrowed bottom portion.

8. The alarm of claim 7 wherein said bottom portion has an offset, rounded bottom edge, said edge having a nonskid surface.

9. The alarm of claim 1 wherein said housing means includes a lower portion adapted to provide the alarm with an unstable, asymmetrical base so said alarm must be supported laterally to remain upright when placed on a generally flat surface.

* * * * *